US005516986A

United States Patent [19]

Peterson et al.

[11] Patent Number: 5,516,986

[45] Date of Patent: May 14, 1996

[54] MINIATURE ELECTRIC CABLE

[76] Inventors: Edwin P. Peterson, 4420 Hillcrest, Boise, Id. 83705; Edwin L. Wheeler, 1865 N. Summertree Way, Meridian, Id. 83642

[21] Appl. No.: 284,359

[22] Filed: Aug. 26, 1994

[51] Int. Cl.[6] ..... H01B 7/08

[52] U.S. Cl. ..... 174/113 C; 174/108; 174/117 E; 174/126.1; 174/131 A

[58] Field of Search ..... 174/108, 113 C, 174/117 R, 117 F, 126.1, 128.1, 131 A; 156/50, 51

[56] References Cited

U.S. PATENT DOCUMENTS

| | | | |
|---|---|---|---|
| 1,275,469 | 8/1918 | Pruessman . | |
| 2,438,006 | 6/1944 | Gustafson | 174/112 |
| 2,458,243 | 1/1949 | Biddle | 57/140 |
| 2,581,212 | 1/1952 | Spooner, Jr. et al. | 219/46 |
| 2,941,176 | 6/1960 | Jacoby | 338/262 |
| 3,037,068 | 5/1962 | Wessel | 174/69 |
| 3,760,319 | 9/1973 | Kawazoe | 338/26 |
| 3,823,253 | 7/1974 | Walters et al. | 174/69 |
| 4,082,585 | 4/1978 | Kanotz et al. | 156/51 |
| 4,090,763 | 5/1978 | Congdon et al. | 339/103 |
| 4,166,881 | 9/1979 | Congdon et al. | 428/463 |
| 4,221,756 | 9/1980 | Piper et al. | 264/174 |
| 4,277,642 | 7/1981 | Piper | 174/117 F |
| 4,313,645 | 2/1982 | Cocco | 339/103 |
| 4,503,285 | 3/1985 | Darms et al. | 428/458 |
| 4,567,321 | 1/1986 | Harayama | 174/117 F |
| 4,637,955 | 1/1987 | Glaister | 428/379 |
| 4,646,987 | 3/1987 | Peterson | 242/107.11 |
| 4,820,012 | 4/1989 | Asai . | |
| 4,835,340 | 5/1989 | Muz | 174/119 |
| 4,910,359 | 3/1990 | Dougherty | 174/69 |
| 5,354,954 | 10/1994 | Peterson | 174/113 C |

FOREIGN PATENT DOCUMENTS

| | | | |
|---|---|---|---|
| 2023328 | 12/1979 | Germany | 7/28 |
| 3516708 | 11/1986 | Germany . | |

*Primary Examiner*—Morris H. Nimmo
*Attorney, Agent, or Firm*—Frank J. Dykas

[57] ABSTRACT

A multiple wire electric cable (10) having a plurality of conductive wires (12), each formed of a multifilament tensile core (14) of unbonded aramid fibers (16). Said conductive wires (12) further having at least a pair of tinsel conductor ribbons (18, 20), spirally wrapped in the same direction about tensile core (14). Further, each of conductor wires (12) arranged in an orientation wherein the spiral wraps of conductor tinsel in each conductor wire (12) are in alternating directions from one conductive wire to the next.

26 Claims, 3 Drawing Sheets

MINIATURE ELECTRIC CABLE

RELATED APPLICATIONS

This application is a continuation of PCT patent application number PCT/US92/07452 filed on Sep. 3, 1992 and designating the United States.

BACKGROUND OF THE INVENTION

1. Technical Field

This invention relates to a small size electric cable primarily for telephone, data and other signal transmissions where cable tensile strength, flexibility, and flat cable ductility are the major concerns.

2. Background Art

In the electronics field there is a general class of flexible cables known as tinsel cables. Tinsel cables are used in applications where great flexibility for the cable is required. Generally they are constructed by spiral wrapping a tensile foil of conductive material, usually copper or copper alloy, around a tensile filament or element, usually nylon or polyester. The wire is then coated with a thermoplastic insulating material. The required number of independent wires are then arranged in a ribbon and jacketed with a second plastic material to form a multi-wire, flexible cable, which can be subjected to repeated flexure without fatiguing the conductive tensile metal foil.

In the past, the primary structural member able to withstand tensile stress in these prior art flexible cables was the plastic jacket. However, there was present a trade-off between tensile strength of the cable and ductility. In order to assure a flexible cable having high tensile strength, the cross-sectional area of the plastic jacket was increased, which resulted in a decrease in ductility. Conversely, as the cables were miniaturized by minimizing the cross-sectional area of the plastic jacket, ductility increased but tensile strength decreased. At the dimensional sizes taught by the present invention, there is insufficient plastic material in the plastic jacket to be of any significant use as a structural member able to withstand even moderate tensile stress.

To compensate for the loss of tensile strength resulting from miniaturization or reduction in the cross-sectional area of the plastic jacket, aramid fibers from the family of aromatic polyamides were substituted for the nylon and polyester filaments used in the past. These aromatic polyamides have, in addition to high tensile strength, another favorable property over the older nylon and polyester filaments, namely they are relatively inelastic. Nylon and polyester tensile filaments are subject to elongation factors of ten per-cent at strain forces of a mere 4 grams/denier (35 cN/Tex) and will break at force levels of approximately 8 grams per denier (70 cN/Tex). These forces can be easily incurred in miniature cables by inadvertently tugging on the cable or, in a localized fashion, merely by folding and crimping the cable.

The elasticity of the nylon and polyester filaments cause problems with single wraps of tinsel when wrapped in a helical spiral fashion about each filament, in that the elasticity of the filament greatly exceeded that of the copper or the copper alloy tinsel foil. This resulted in a loss of, or reduced, conductivity and eventual breakage of the cable.

To compensate for this, it is standard practice in the industry to provide for two wraps of tinsel foil about each cable. To insure electrical conductivity, each of these wraps is, as taught in the prior art, wrapped in a helically spiral opposite to the other, that is to say, one in a clockwise direction, and the other in a counter-clockwise direction to solve the problem of maintaining good conductivity under conditions of tensile stretching in cables having nylon or polyester tensile filaments.

The opposing spiral design, originally adopted to compensate for tensile stretching, has been carried over into the new non-elastic tensile filament cables using aromatic fibers. But this design has an inherent defect, in that if the cable is twisted, it will wrap the helical spiral of tinsel tighter in one direction, and unwrap the tinsel foil which was wrapped in the other direction. This results in an abrasion of metal-to-metal rubbing between the two helical spiral wraps. In practice it has been found that there is a significant amount of abrasion between the opposing spiral wraps, and eventual cutting of the outer wrap into the inner wrap and a resulting loss of conductivity or cable failure.

In practice it has been found that if both wraps of tinsel foil are made in the same direction, there is less abrasion, better conductivity, and an extended cable life. However, unidirectional double wrapping is not done because it induces a torsional stress into the conductive wire in the opposite direction from that in which the coils are wrapped, by reason of the coils tending to unwrap themselves from the filament. In cases of extremely ductile miniature cables, this actually can result in a multi wire cable assuming a helical spiral in a direction opposite that to which the tinsel is wrapped inside the cable.

Accordingly, it is an object of this invention to provide a miniature electric cable of high tensile strength, small cross-sectional area, with maximum wear unidirectional multiple layered spirals of conductive tinsel foil that will lie flat even though it is extremely ductile.

DISCLOSURE OF INVENTION

These objects are achieved through a multiple wire electric cable containing at least two conductive wires held in parallel spaced relationship within a flexible thermal plastic jacket formed from the family of polyether amides. Each of the conductive wires has a tensile element formed of a plurality of unbonded filaments of aramid fiber from the family of aromatic polyamides. Spirally wrapped about each of the tensile filaments are at least two tinsel ribbons. Both tinsel ribbons are wrapped in the same direction, with one overlaying the other.

The conductive wires are placed into an array within the thermal plastic jacket in an orientation such that the spiral wraps of tinsel foil in each conductive wire is in an opposite direction, one conductive wire to the next following conductive wire, so as to cancel out the twisting forces induced by the wraps of tinsel foil about the filaments. These cables, even though extremely ductile and pliable, will lie flat when not under tensile load.

BEST MODE FOR CARRYING OUT INVENTION

Figure 1:
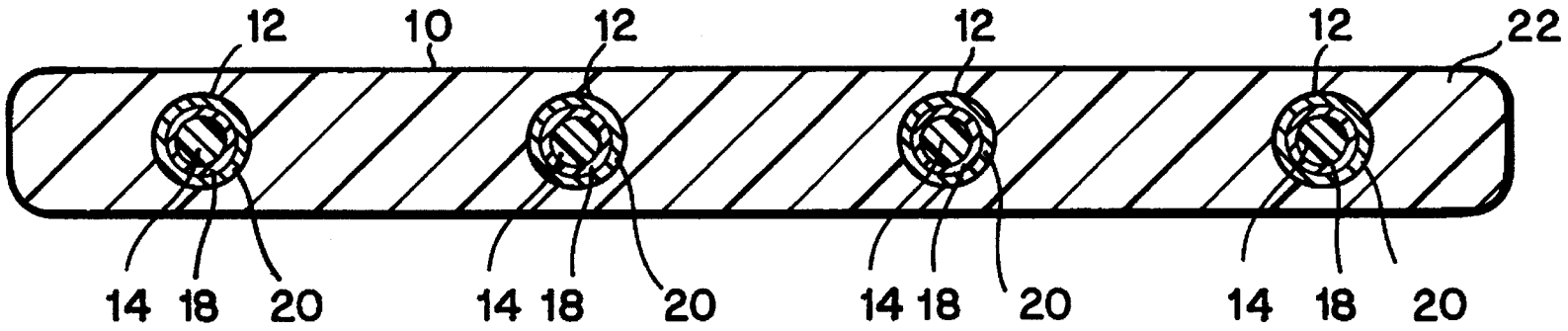
FIG. 1 is a greatly enlarged cross sectional view of the cable.
Figure 2:
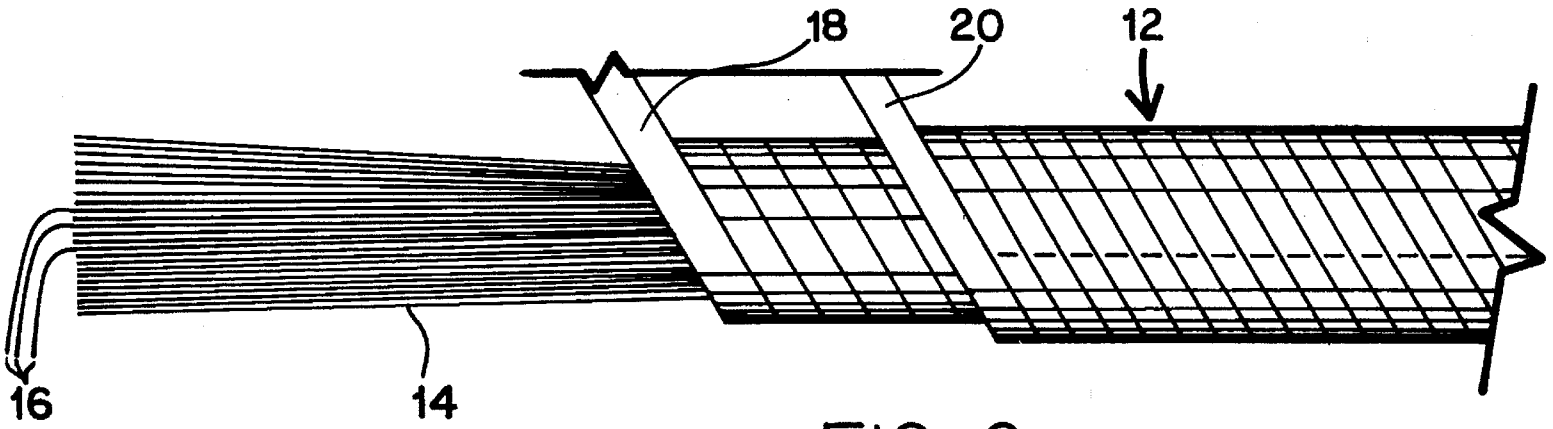
FIG. 2 is a schematic view in side elevation illustrating the method of manufacture of one of the conductors in the cable.

FIG. 1 shows a greatly enlarged view of multiple wire electric cable 10 containing four parallel, spaced apart conductor wires 12 held within an extruded thermoplastic 22 to form a flexible multiple wire cable. In the present embodiment each conductor wire 12 has a tensile core 14 comprised of a plurality of separate unbonded filaments 16 around which is wrapped a first tinsel ribbon 18, and then wrapped in the same direction and overlaying first tinsel ribbon 18, a second tinsel ribbon 20 as shown in FIG. 2. For purposes of illustration in this specification, electric cable 10 contains four conductor wires 12, however, it should be apparent that the principles taught herein are equally applicable to any flexible multiple wire cable.

Tensile filament core 14 of this conductor wire 12 is fabricated of a plurality of separate unbonded filaments 16 of an aramid fiber from the family of aromatic polyamides. In the preferred embodiment, this is preferably KEVLAR®, which is a registered trademark of the DuPont Corporation. The aramid fibers are much less susceptible to elongation, suffering approximately 1% elongation at 4 grams/denier (35 cN/Tex) and have a much higher resistance to breakage, at 22 grams/denier (194.2 cN/Tex), which is almost three times stronger than that found in a conductor wire using conventional nylon tinsel filaments.

In the preferred embodiment, each of tensile cores 14 in four wire cable 10 has a cross-sectional area of 7.74 square millimeters. The tinsel ribbons, 18 and 20, are at least 98% copper and the remainder cadmium, but preferably they are 1% cadmium and 99% copper. They are 0.05 mm thick and 0.508 mm wide, although other alloys of copper or other conductive materials may be used.

The preferred extruded insulating thermoplastic material 22 is a thermoplastic selected from the family of polyether amides, and this is preferably PEBAX®, which is a registered trademark of ATOCHEM, Inc. This is an extremely flexible material.

The centers of the four parallel conductor wires 12 are spaced apart from each other 1.02 mm. In this configuration, each of the conductor wires 12 have a tensile strength of 40N to 44.5N, for a combined cable strength of 160N to 178N. This compares to a standard cable using a nylon tensile core of comparable size which would have a tensile strength of only between 53N to 67N.

While first and second tinsel ribbons 18 and 20 are formed of a relatively ductile material, there is some residual elasticity and as a result there is an inherent twisting force induced as a result of the tendency of the tinsel strips attempting to unwrap themselves from tensile filament core 14. In the past, the prior art solution adopted to eliminate this twist induced by the tendency to unwrap has been to wrap the first conductive tinsel foil spirally in one direction about tensile core 14, and the second conductive tinsel ribbon in the opposite direction, thus canceling the induced tendency for the wire to twist. However, it has been found in practice that the tinsel ribbons slide over each other as electrical wire cable 10 is repeatedly bent, causing a chafing and fractures resulting from the friction, which can eventually lead to fatigue and failure of the conductive wires. It has been found in practice that if both tinsel ribbons 18 and 20 are wrapped in the same direction, this frictionally induced fracture and failure is greatly reduced, thus extending the useful life of the cable.

However, as previously stated, wrapping both conductive tinsels 18 and 20 in the same direction does not provide for any means to cancel out the induced twist in conductive wires 12. It has been found in practice that if conductive wires 12, as taught in the present invention, were formed into multiple wire electric cable 10, in an array wherein the spiral wrappings of conductive material for each of the conductive wires (12) were each wrapped in the same direction, it will actually induce a loose helical twist into cable 10 to the extent that the cable will not lay flat when not under tensile load.

Figure 4:
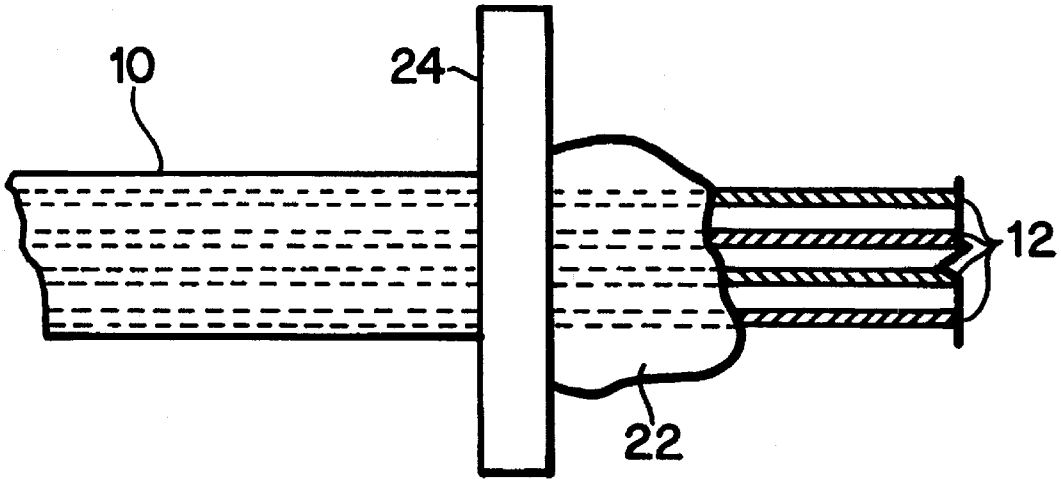
FIG. 4 is a schematic top view illustrating the alternating pattern of setting of parallel conductors having opposing wraps of conductive foil.
Figure 3:
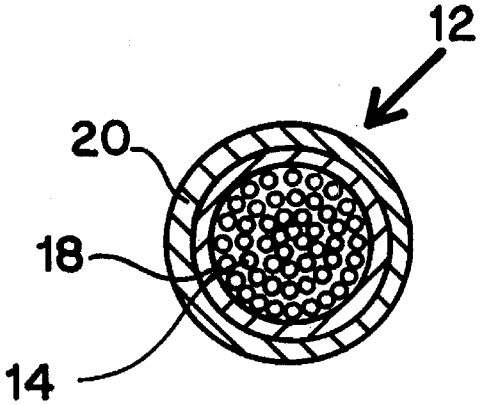
FIG. 3 is a cross-sectional view of one of the conductors in FIG. 1.
Figure 5:
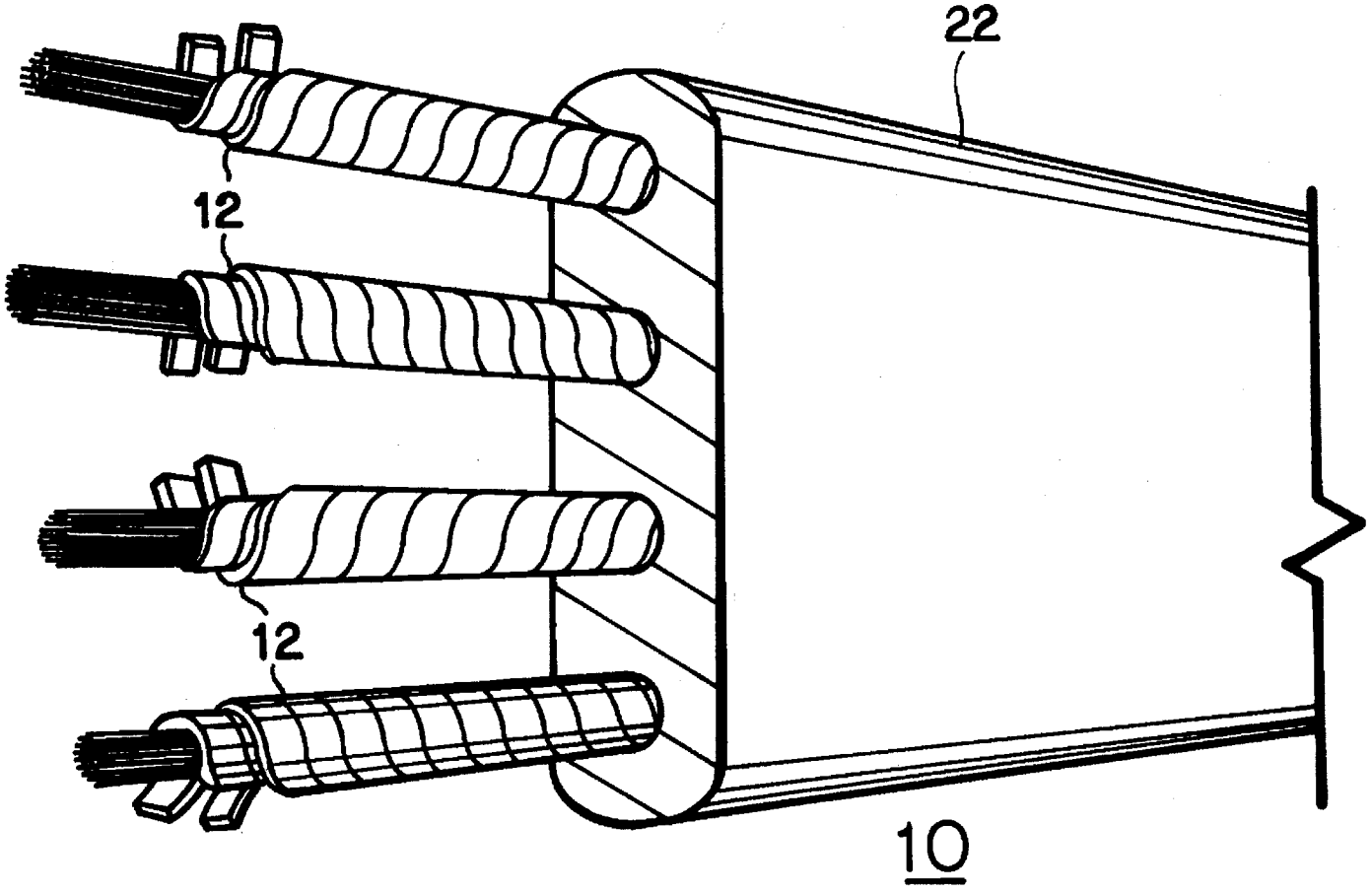

Since no torque canceling forces are provided by the double wraps of tinsel in the same direction, the conductive wires 12 are oriented within the array of cable 10, such that the orientation of the wraps of conductive tinsel of each conductive wire are arranged in alternating directions from one conductive wire to the next. In this manner, the torque created by the spiral wraps of tinsel foil in one conductive wire is cancelled out by the torque created by the spiral wraps of tinsel foil in the next following conductive wire. This is shown in FIG. 4, and it provides the necessary canceling forces to eliminate the tendency of the cable to twist. FIG. 4 also illustrates the extrusion process to produce four conductor cable 10 as shown in FIG. 1. The four conductor wires 12 are fed in parallel spaced relationship in the orientation of alternating directions of spiral wrapping of a conductive tinsel, through moltant block polyamide thermoplastic material 22 in extrusion die 24.

The result is multiple wire electric cable 10 which is extremely flexible, has a low elongation factor, and more resistant to loss of conductivity by fracture and fatigue of tinsel coils 18 and 20, yet at the same time will still lie completely flat when not under tensile load.

While there is shown and described the present preferred embodiment of the invention, it is to be distinctly understood that this invention is not limited thereto but may be variously embodied to practice within the scope of the following claims.

I claim:

1. A multiple wire electric cable consisting essentially of:

a plurality of conductive wires each having a tensile load bearing filament surrounded by a plurality of overlaid, spirally wrapped, strips of conductive material with each of the strips of conductive material for each conductive wire spirally wrapped about the strand of filaments in the same direction, and with each of said conductive wires arranged in a parallel array in spaced apart relationship wherein the direction of the spiral wrappings of conductive material of each of the conductive wires of the array are arranged in an orientation of alternating directions from one conductive wire to the next; and said parallel array of conductive wires being held within a single thermoplastic insulating jacket.

2. The multiple wire electric cable of claim 1 wherein said tensile load bearing filaments are characterized as unbonded multi-filament strands of tensile load bearing fibers.

3. The multiple wire electric cable of claim 2 wherein said unbonded multi-filament strands of tensile load bearing fibers are further characterized as aramid fibers.

4. The multiple wire electric cable of claim 1 wherein said thermoplastic insulating jacket is further characterized as a block polyamide.

5. The multiple wire electric cable of claim 2 wherein said thermoplastic insulating jacket is further characterized as a block polyamide.

6. The multiple wire electric cable of claim 3 wherein said thermoplastic insulating jacket is further characterized as a block polyamide.

7. The multiple wire electric cable of claim 1 wherein the conductive material is characterized as an alloy formed of at least ninety eight percent copper and the remainder of cadmium.

8. The multiple wire electric cable of claim 2 wherein the conductive material is characterized as an alloy formed of at least ninety eight percent copper and the remainder of cadmium.

9. The multiple wire electric cable of claim 3 wherein the conductive material is characterized as an alloy formed of at least ninety eight percent copper and the remainder of cadmium.

10. The multiple wire electric cable of claim 4 wherein the conductive material is characterized as an alloy formed of at least ninety eight percent copper and the remainder of cadmium.

11. The multiple wire electric cable of claim 5 wherein the conductive material is characterized as an alloy formed of at least ninety eight percent copper and the remainder of cadmium.

12. The multiple wire electric cable of claim 6 wherein the conductive material is characterized as an alloy formed of at least ninety eight percent copper and the remainder of cadmium.

13. The multiple wire electric cable of claim 6 wherein the conductive material is characterized as an alloy formed of at least ninety eight percent copper and the remainder of cadmium.

14. The multiple wire electric cable of claim 1 wherein the pairs of conducting are limited in number to two pairs totalling four wires with a spacing of approximately 1.02 mm between any two adjacent wires.

15. The multiple wire electric cable of claim 2 wherein the pairs of conducting are limited in number to two pairs totalling four wires with a spacing of approximately 1.02 mm between any two adjacent wires.

16. The multiple wire electric cable of claim 3 wherein the pairs of conducting are limited in number to two pairs totalling four wires with a spacing of approximately 1.02 mm between any two adjacent wires.

17. The multiple wire electric cable of claim 4 wherein the pairs of conducting are limited in number to two pairs totalling four wires with a spacing of approximately 1.02 mm between any two adjacent wires.

18. The multiple wire electric cable of claim 5 wherein the pairs of conducting are limited in number to two pairs totalling four wires with a spacing of approximately 1.02 mm between any two adjacent wires.

19. The multiple wire electric cable of claim 6 wherein the pairs of conducting are limited in number to two pairs totalling four wires with a spacing of approximately 1.02 mm between any two adjacent wires.

20. The multiple wire electric cable of claim 7 wherein the pairs of conducting are limited in number to two pairs totalling four wires with a spacing of approximately 1.02 mm between any two adjacent wires.

21. The multiple wire electric cable of claim 8 wherein the pairs of conducting are limited in number to two pairs totalling four wires with a spacing of approximately 1.02 mm between any two adjacent wires.

22. The multiple wire electric cable of claim 9 wherein the pairs of conducting are limited an number to two pairs totalling four wires with a spacing of approximately 1.02 mm between any two adjacent wires.

23. The multiple wire electric cable of claim 10 wherein the pairs of conducting are limited in number to two pairs totalling four wires with a spacing of approximately 1.02 mm between any two adjacent wires.

24. The multiple wire electric cable of claim 11 wherein the pairs of conducting are limited in number to two pairs totalling four wires with a spacing of approximately 1.02 mm between any two adjacent wires.

25. The multiple wire electric cable of claim 12 wherein the pairs of conducting are limited in number to two pairs totalling four wires with a spacing of approximately 1.02 mm between any two adjacent wires.

26. The multiple wire electric cable of claim 13 wherein the pairs of conducting are limited in number to two pairs totalling four wires with a spacing of approximately 1.02 mm between any two adjacent wires.

* * * * *